US006234838B1

(12) United States Patent
Wong

(10) Patent No.: US 6,234,838 B1
(45) Date of Patent: May 22, 2001

(54) STRUCTURE FOR A COAXIAL CABLE CONNECTOR

(76) Inventor: Shen-Chia Wong, No. 10, Lane 121, Li-Der Road, Peito District, Taipei (TW)

( * ) Notice: Subject to any disclaimer, the term of this patent is extended or adjusted under 35 U.S.C. 154(b) by 0 days.

(21) Appl. No.: 09/414,593

(22) Filed: Oct. 8, 1999

(51) Int. Cl.[7] ..... H01R 13/40; H01R 33/945; H01R 11/20; H01R 4/32; H01R 13/58

(52) U.S. Cl. ..... 439/578; 439/587; 439/394; 439/779; 439/462

(58) Field of Search ..... 439/394, 578, 439/587, 779, 462

(56) References Cited

U.S. PATENT DOCUMENTS 4,556,271 * 12/1985 Hubbard ..... 439/277
5,295,864 * 3/1994 Birch et al. ..... 439/578
5,431,583 * 7/1995 Szegda ..... 439/589
5,830,009 * 11/1998 Tettinger ..... 439/578

* cited by examiner

*Primary Examiner*—Paula Bradley
*Assistant Examiner*—Edwin A. León
(74) *Attorney, Agent, or Firm*—Dougherty & Troxell

(57) ABSTRACT

An improved structure for a coaxial cable connector is disclosed. The surface consists of a connector body, an axle collar, a stem disposed co-axially within the axle collar, and a nut disposed rotatably around the stem. The nut includes an annular end and a hexagonal body. The annular end has a threaded bore hole which is used for accepting a threaded interface connector. An annular groove is formed along the inner surface of the threaded bore hole; while another annular groove is formed around the outer surface of the threaded interface connector, both for filling a sealing element thereinto thereby providing a 360 degrees annular moisture proof hermetic structure between the interface connector and the nut.

1 Claim, 7 Drawing Sheets

STRUCTURE FOR A COAXIAL CABLE CONNECTOR

BACKGROUND OF THE INVENTION (1) Field of the Invention

The present invention relates to an improved structure for a coaxial cable connector, and more particularly, to improved hermetic structure for a coaxial cable connector which is able to perfectly shut out moisture therefrom.

(2) Description of the Prior Art

A coaxial cable connector is very well known to people who engage in the work of electronic and communication cable engineering. An F type coaxial cable connector is typically screw combined to an auxiliary interface connector for electrically joining integrally a coaxial cable to various electronic devices such as TV, CB, FM radio receiver or amateur radio systems.

A conventional coaxial cable connector transmits electrical signals by reliably engaging its connector with the coaxial cable shielding layer. However, one of the shortcomings of a conventional coaxial cable connector is its susceptibility to moisture infringement, that is, the moisture infringes into the connector through the clearance between the connector body and the interface connector.

FIG. 1 is a cross sectional view of a conventional coaxial cable connector in engagement with an interface connector. As shown in FIG. 1, an F type connector is used as a representative example for all conventional coaxial cable connectors. The F type coaxial cable connector 10 consists of a connector body 11, an axle collar 12, a stem 13 co-axially disposed within the axle collar 12, and a nut 14 surrounding the stem 13. The connector 10 further includes a sealing element 15 sandwiched between the inner surface of the nut 14 and the outer surface of the stem 13.

Both the insulating layer and the center conductor of the coaxial cable are inserted within the stem 13 by aligning a terminal 16 of the connector body 11 coincident with the end of the connector 10 so that the connector is engaged with the coaxial cable. Both braided shielding layer and cable jacket are interposed between the outer surface of the stem 13 and the axle collar 12 and are connected by exerting a compressive force with a hexagonal compression tool to the axle collar 12 so as to hermetically engage the connector 10 with the cable jacket.

Incidentally, there is a problem inherent to the combination of the F type coaxial cable connector 10 and an interface connector 17. That is, the infringement of moisture may occur at the incomplete screw contact surfaces between the nut 14 and the interface connector 17, as shown by arrow 18. The infringement of moisture through the clearance shown by arrow 18 between the nut 14 and the interface connector 17 can be prevented by filling a sealing element 15 therebetween. However, the infringement of moisture 19 can further occur at the contact surface between the interface connector 17 and the stem 13 with the result of leaking of wire TV wave and degrading the signal transmission property of the connector 10. Consequently, the infringement of moisture 19 between the interface connector 17 and the stem 13 still has to be eliminated.

FIG. 2 is a cross sectional view showing the state of an output/input terminal coupling relation between a conventional interface connector and an electronic device. FIG. 2 shows that the infringement of moisture may occur at the incomplete contact surfaces between the nut 14 and an electronic device 101. The infringement of moisture 102 can be excluded by means of filling a rubber element 103 thereinto. But such a treatment requires consumption of additional material and increases the manufacturing cost and time.

SUMMARY OF THE INVENTION

In order to solve the above described problem of moisture infringement inherent to the conventional techniques, the present inventor carried out theoretical studies and stimulating experiments, based on these studies and researches, the present inventor came to propose the present invention.

It is an object of the present invention to provide an improved structure for a coaxial connector in which a moisture proof hermetic structure is formed between the nut, the interface connector and the stem so as to shut out moisture infringement.

To carry out the above object, the coaxial cable connector of the present invention consists of a connector body, an axle collar, a stem co-axially within the axle collar, and a nut disposed rotatably surrounding the stem. The nut includes an annular end and a hexagonal body. The annular end has a threaded bore hole which is used for accepting a threaded interface connector. An annular groove is formed around the inner surface of the threaded bore hole; while another annular groove is formed around the outer surface of the threaded interface connector, both for filling with a sealing element thereinto thereby providing a 360 angles annular moisture proof hermetic structure between the interface connector and the nut.

BRIEF DESCRIPTION OF THE DRAWINGS

The accompanying drawings which are included to provide a fuller understanding of the invention and incorporated in and constitute a part of this specification, illustrate embodiment of the invention and together with the description serves to explain the principles of the invention, wherein.

DETAILED DESCRIPTION OF THE PREFERRED EMBODIMENT

Hereinafter, the best mode for carrying out the present invention will be described more fully below with reference to attached drawings.

Figure 1:
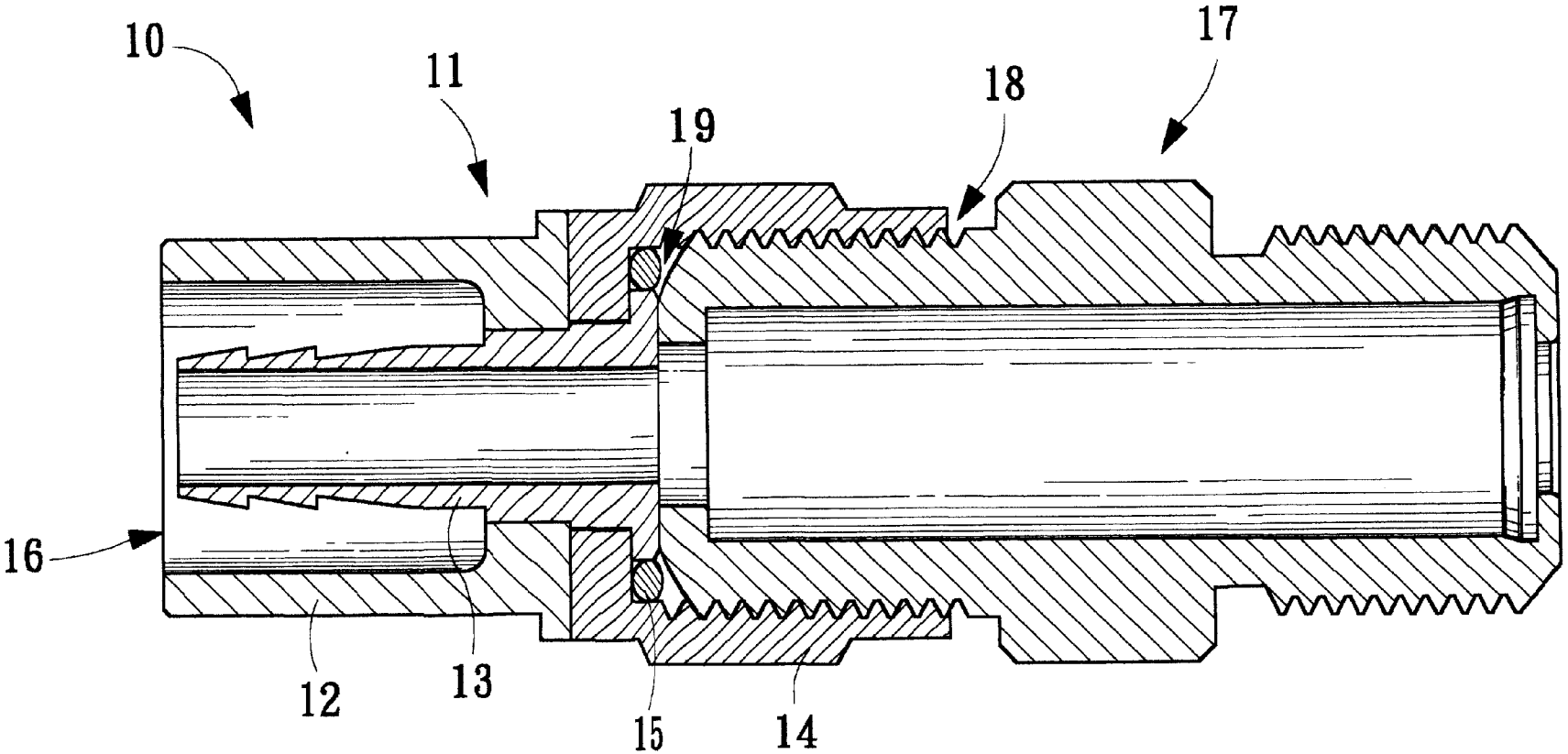
FIG.1 PRIOR ART
FIG. 1 is a cross sectional view of a conventional coaxial cable connector in engagement with an interface connector.
Figure 2:
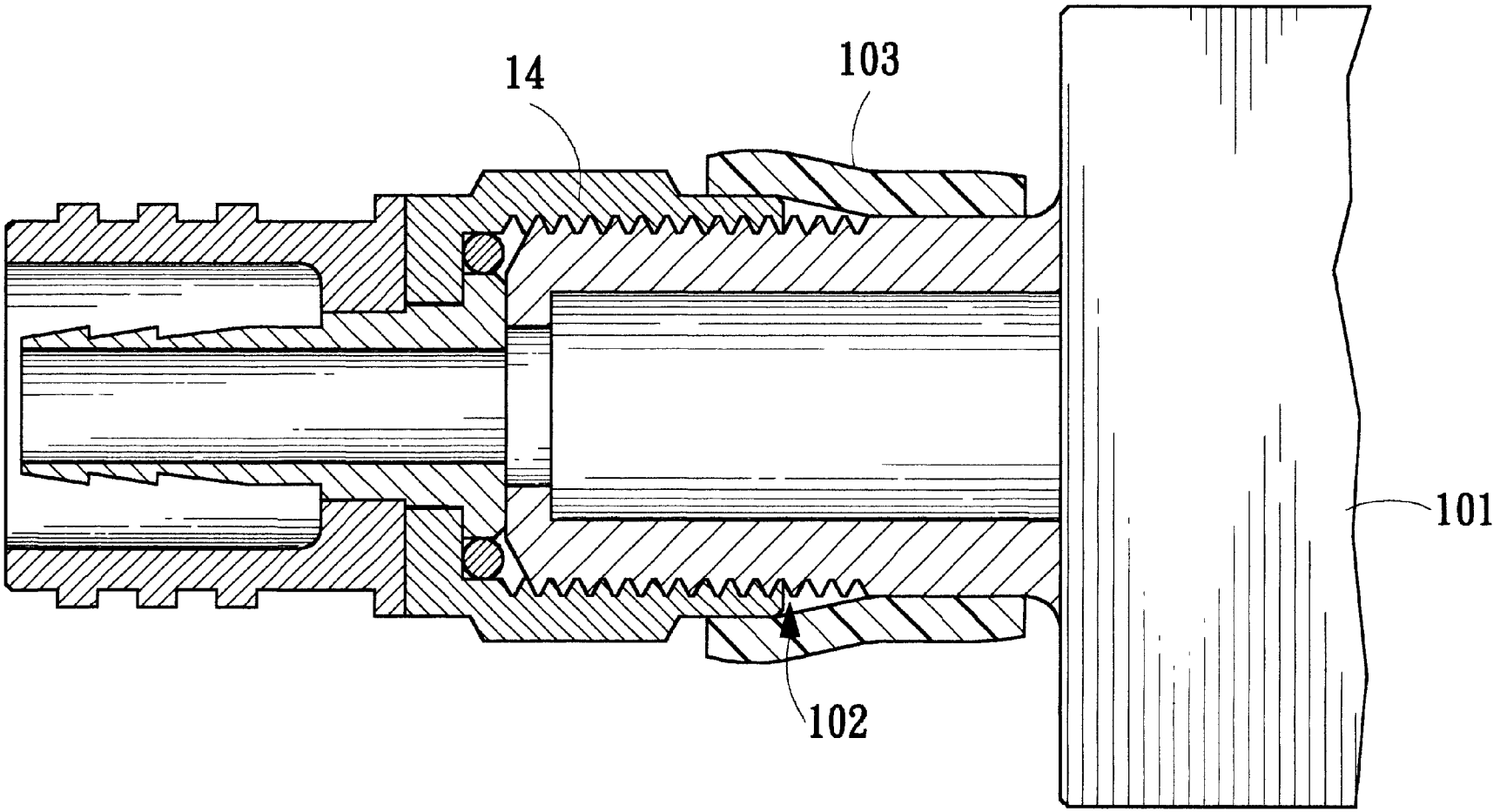
FIG.2 PRIOR ART
FIG. 2 is a cross sectional view of a conventional coaxial cable connector in engagement with an electronic device having a threaded interface connector.
Figure 3:
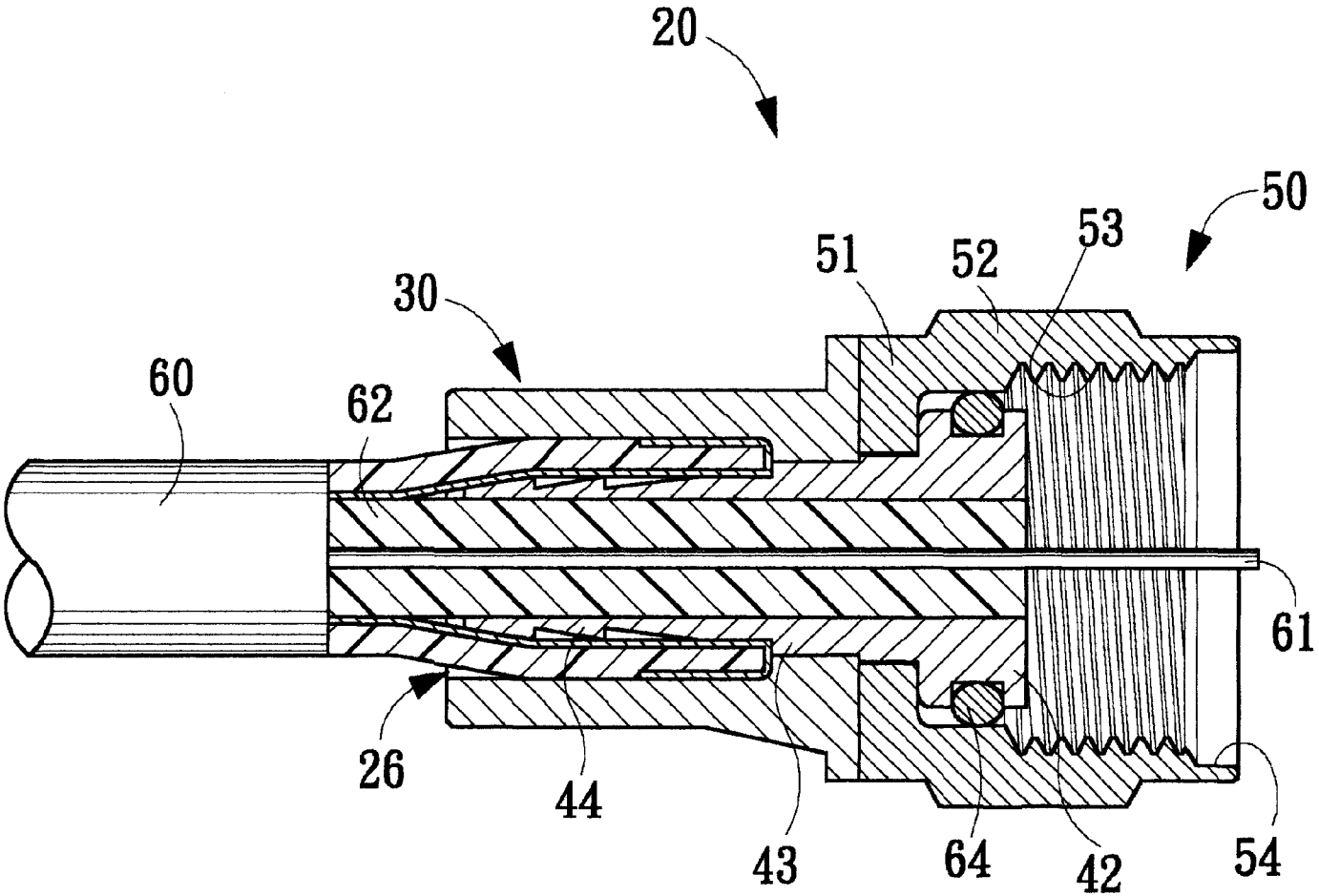
FIG. 3 is a cross sectional view of a coaxial cable connector of the present invention being fitted to a coaxial cable.
Figure 4:
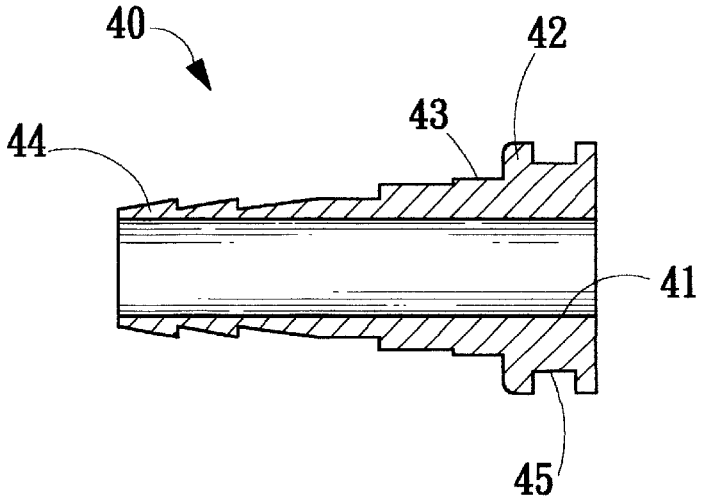
FIG. 4 is a cross sectional view of the stem which is a component of the coaxial cable connector of the present invention.

Referring to FIG. 3 and FIG. 4 simultaneously, the coaxial cable connector of the present invention consists of a connector body 20, an axle collar 30, a stem 40 disposed co-axially within the axle collar 30, and a nut 50 disposed surrounding the stem 40.

The stem 40 has a through bore hole 41 with a diameter able to accommodate a center conductor 61 and an insulation layer 62 of a coaxial cable 60. The stem 40 further has a flanged ring 42, an interface portion 43 and a protruding tubular end 44.

Figure 5A:
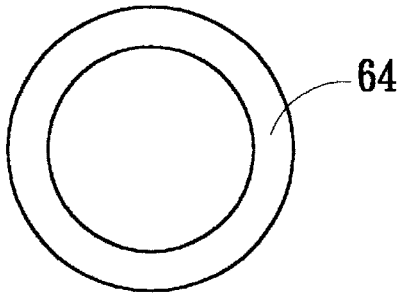
FIGS. 5A and 5B are a plan view and a cross sectional view of the sealing element employed by the present invention respectively.
Figure 5B:
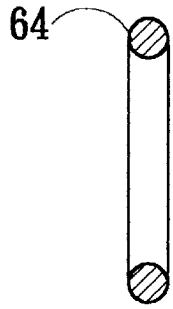

An annular groove 45 is formed along the outer circumference of the flanged ring 42 for a sealing element 64 to be fitted therein thereby preventing infringement of moisture from the clearance between the stem 40 and the nut 50. The sealing element 64 shown in FIGS. 5A and 5B is formed into a shape of O ring made of synthetic rubber or other elastic materials.

Figure 6:
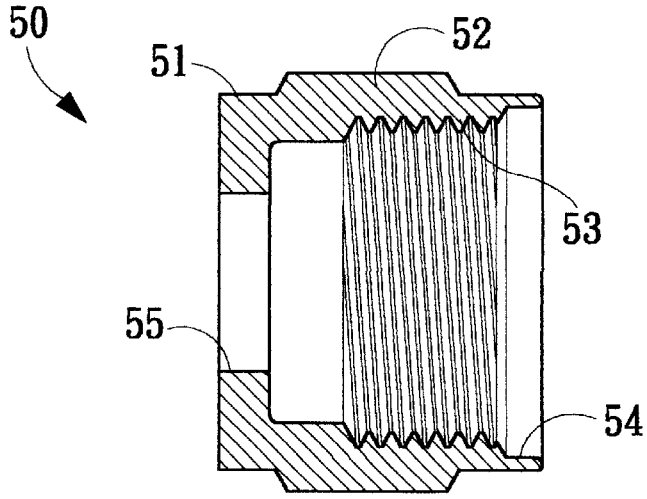
FIG. 6 is a cross sectional view of a nut which is a component of the coaxial cable connector of the present invention.
Figure 7:
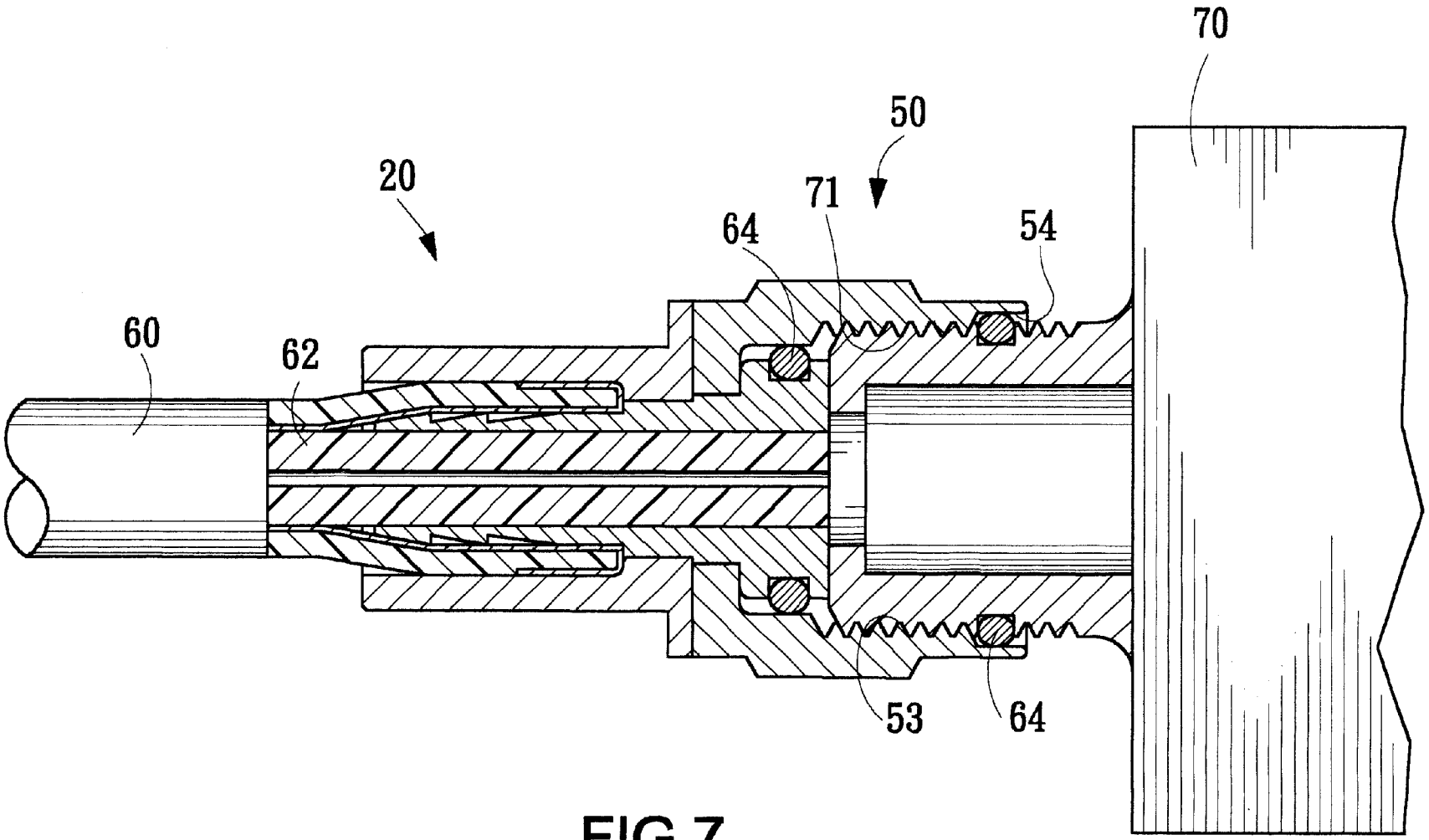
FIG. 7 is a cross sectional view of a coaxial cable connector of the present invention in engagement with an electronic device.

Referring to FIG. 6 and FIG. 7 simultaneously, the nut 50 consists of an annular end 51 and a hexagonal body 52. The annular end 51 has a bore hole 55 for engaging with the interface portion 43 of the stem 40. The hexagonal body 52 has threaded bore hole 53 used to screw onto an electronic device 70. An annular slot 54 is formed around the end surface of the threaded bore hole 53.

The electronic device 70 has an interface connector 71 with a plurality of threads. An annular groove 72 is formed along the outer surface of the interface connector 71 for the sealing element 64(shown in FIG. 5A and 5B) to be filled therein thereby providing a 360 degrees annular moisture proof hermetic structure between the interface connector 71 and the nut 50.

The connector body 20 is used to interconnect the coaxial cable 60 and the electronic device 70 by combining the thread bore hole 53 of the nut 50 with the interface connector 71. At the same time, the sealing element 64 is filled in the annular slot 54 and the sealing element 64 is sandwiched and squeezed between the annular slot 54 and the annular groove 72 so as to provide moisture sealing effect therebetween.

Figure 9:
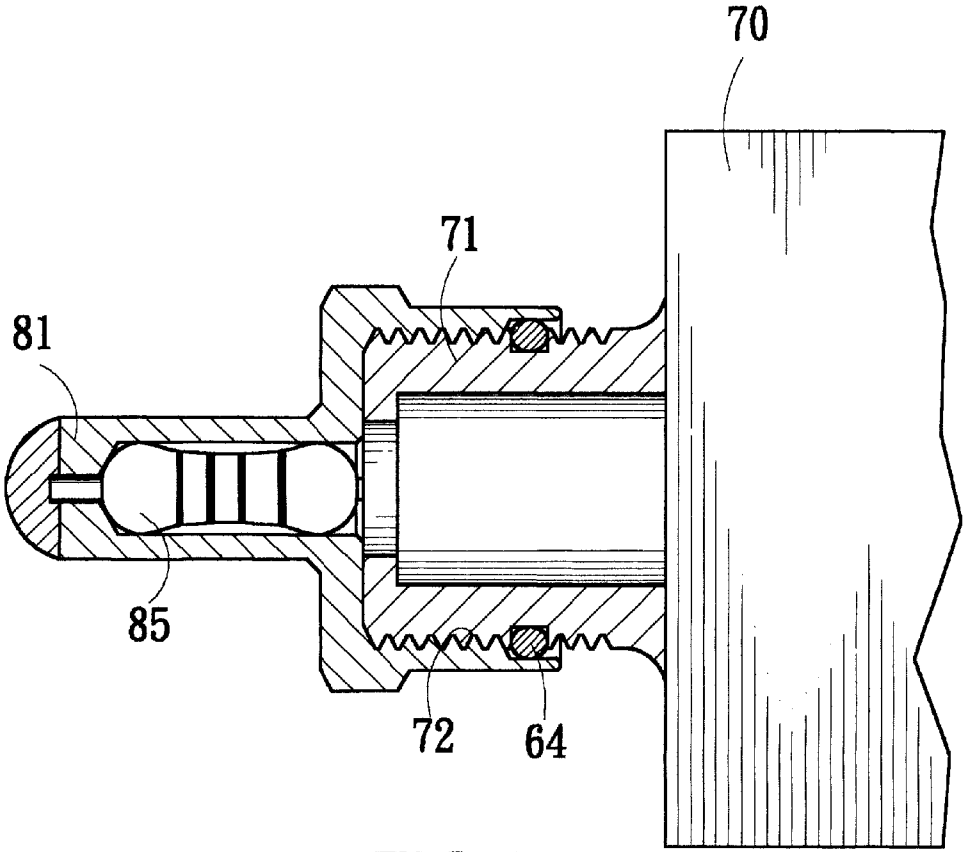
FIG. 9 is a cross sectional view of a terminal joint of the present invention coupling with an electronic device.
Figure 8:
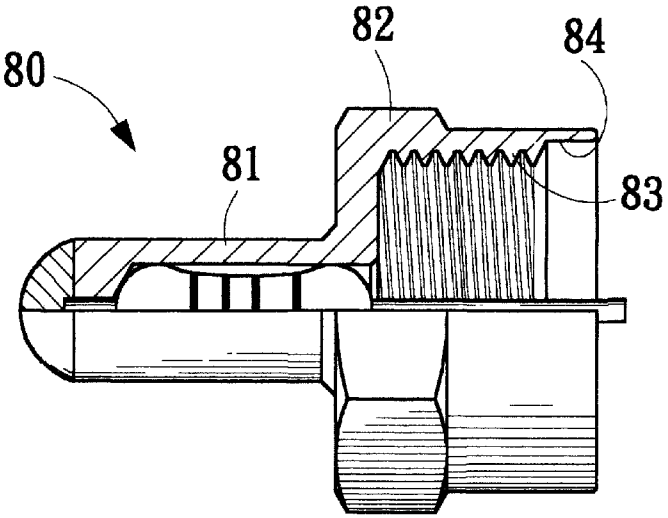
FIG. 8 is a cross sectional view of a terminal joint of the present invention.

As shown in FIG. 8 and FIG. 9, a terminal joint 80 is connected to the electronic device 70 by screwing onto to an unoccupied portion of the threaded interface connector 71 so as to prevent wave leakage. The terminal joint 80 includes a grip 81, a nut 82 integrally formed with the grip 81, and a resistor element 85 disposed inside the terminal joint 80. The nut 82 further includes a threaded bore hole 83 and an annular slot 84 formed around the end surface of the threaded bore hole 83.

An annular groove 72 is formed along the outer surface of the threaded interface connector 71 of the electronic device 70 for filling a sealing element 64 therein. The threaded bore hole 83 of the terminal joint 80 is screwing onto to the threaded interface connector 71 thereby providing a 360 degrees annular moisture proof hermetic structure between the terminal joint 80 and the electronic device 70.

Figure 10:
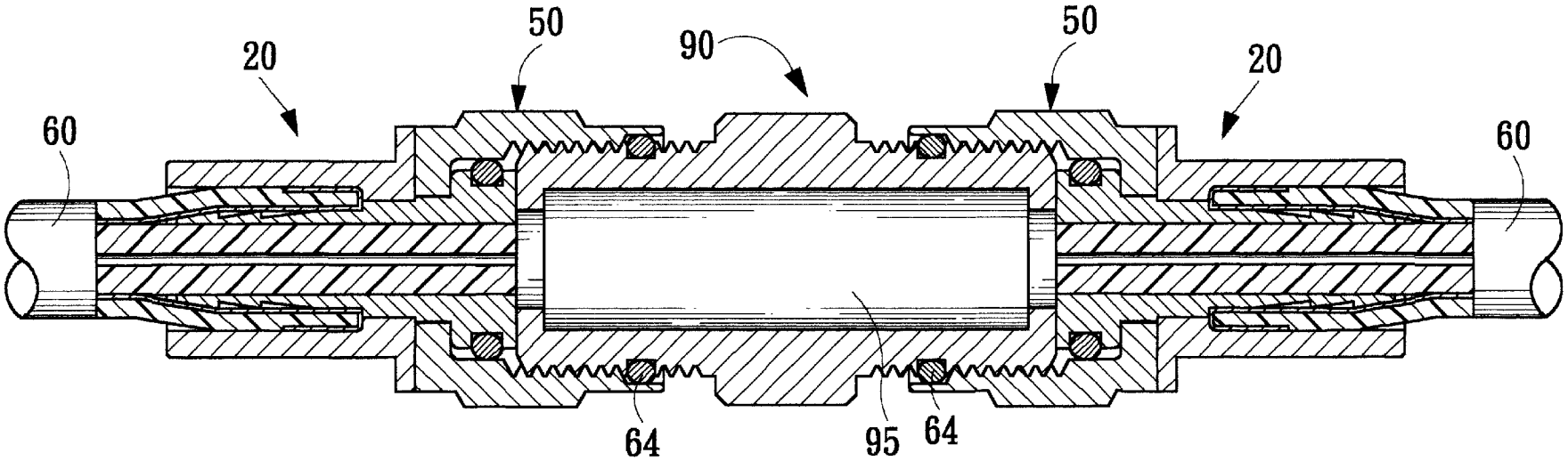
FIG. 10 is a cross sectional view of a coaxial cable connector fitted to an F type coaxial cable connector according to the present invention.
Figure 11:
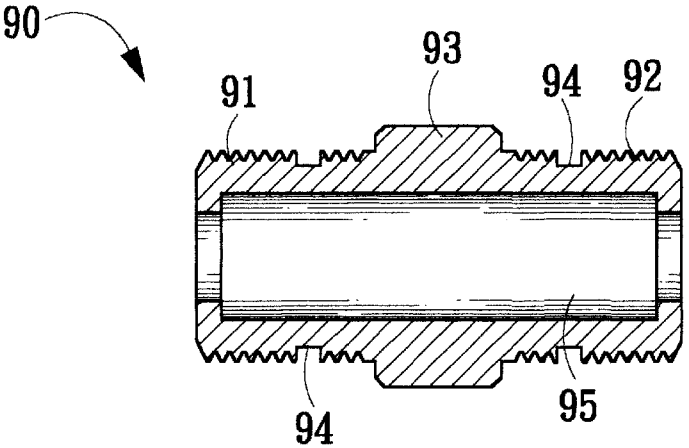
FIG. 11 is a cross sectional view of a coaxial cable connector of the present invention.

Referring to FIG. 10 and FIG. 11 simultaneously, wherein a coaxial cable 60 is connected to the interface connector 90 through the connector body 20. The interface connector 90 includes a first threaded portion 91, a hexagonal body 93, a second threaded portion 92, and a plastic sleeve 95 installed inside the connector 90. An annular groove 94 is formed along each outer end surface of the first and the second threaded portions 91 and 92 to be filled with the sealing element 64 (shown in FIG. 5A, 5B) therein thereby providing a 360 degrees annular moisture proof hermetic structure between the nut 50 and the interface connector 90.

A variety of modifications and variations of the present invention are possible in light of the above teachings. It is therefore to be understood that within the scope of the appended claims, the present invention may be practiced otherwise than as specially described hereinabove.

What is claimed is:

1. An electrical connection between a first electronic element and a resistor, comprising:

a) an interface connector on the first electronic element having a first distal end and a proximal end portion, the interface connector having external threads and an annular groove adjacent to the proximal end portion;

b) a connector body connected to the resistor and having a nut thereon, the nut having a bore hole, internal threads engaging the external threads of the interface connector, and a second distal end with an inward facing annular surface adjacent to the second distal end located such that the annular surface is aligned with the annular groove when the connector body is connected to the interface connector; and, c) an elastic sealing member located in the annular groove and contacting the annular surface to prevent moisture from entering the engaging threads of the nut and the interface connector.

* * * * *